US005698627A

United States Patent [19]

Oguni et al.

[11] Patent Number: 5,698,627

[45] Date of Patent: Dec. 16, 1997

[54] ADDITIVE FOR PAPERMAKING

[75] Inventors: Tadayoshi Oguni; Satoshi Takizawa; Kiyoshi Iwai, all of Chiba-ken, Japan

[73] Assignee: Japan PMC Corporation, Ichihara, Japan

[21] Appl. No.: 624,183

[22] Filed: Mar. 29, 1996

[30] Foreign Application Priority Data

Mar. 30, 1995 [JP] Japan ..... 7-95826

[51] Int. Cl.[6] ..... C08K 5/16

[52] U.S. Cl. ..... 524/724; 524/547; 524/555; 524/761; 524/765; 524/766; 524/767; 524/812; 524/815; 526/292.95; 526/307; 526/307.2; 526/307.3; 526/307.7

[58] Field of Search ..... 524/724, 761, 524/767, 812, 815, 547, 555, 765, 766; 526/292.95, 307, 307.2, 307.3, 307.7

[56] References Cited

U.S. PATENT DOCUMENTS

| | | | |
|---|---|---|---|
| 3,983,059 | 9/1976 | Sekmakas | 524/767 X |
| 4,043,968 | 8/1977 | Spencer et al. | 524/761 |
| 4,134,871 | 1/1979 | Otani et al. | 524/767 |
| 4,230,772 | 10/1980 | Swift et al. | 524/761 X |
| 4,526,937 | 7/1985 | Hsu | 524/724 |
| 4,699,964 | 10/1987 | Kato et al. | 524/761 X |
| 4,717,758 | 1/1988 | Ogawa et al. | 526/307 |
| 5,115,065 | 5/1992 | Ogawa et al. | 526/304 |
| 5,399,616 | 3/1995 | Kuhn et al. | 524/767 X |

FOREIGN PATENT DOCUMENTS

| | | | |
|---|---|---|---|
| 60-94697 | 5/1985 | Japan . | |
| 3227484 | 10/1991 | Japan . | |
| 693594 | 4/1994 | Japan . | |
| 0962709 | 6/1964 | United Kingdom | 524/761 |

*Primary Examiner*—Judy M. Reddick
*Attorney, Agent, or Firm*—Webb Ziesenheim Bruening Logsdon Orkin & Hanson, P.C.

[57] ABSTRACT

A novel additive for papermaking is disclosed. The additive comprises an aqueous solution of a copolymer obtained by reacting (a) an acrylamide, (b) a vinyl monomer which is copolymerizable with component (a) and has a cationic group, (c) at least one of vinyl monomers which are copolymerizable with component (a) and (b) and have 2, 3 or 4 carboxyl groups in a molecule thereof and/or a salt thereof, optionally (e) a nonionic monomer which is copolymerizable with components (a), (b) and (c) if desired, and (d) a cross-linking compound, in the presence of (f) at least one of ethylene glycol, diethylene glycol, diethanolamine and glycerin.

This novel additive for papermaking is able to achieve excellent freeness and retention in the process of papermaking and provides paper with increased strength.

16 Claims, No Drawings

ADDITIVE FOR PAPERMAKING

FIELD OF THE INVENTION

The present invention relates to a polyacrylamide additive for papermaking and a process for papermaking using said additive. More particularly, the invention relates to an additive for papermaking which brings about excellent freeness, high retention and good effect for enhancing the paper strength in a papermaking system of from acidic to neutral and alkaline range and a process for papermaking using the same.

BACKGROUND OF THE INVENTION

In the papermaking process, in order to meet the demand for enhancement of the productivity arising from the recent increased operation speed of papermaking machines, or to improve the paper quality, various additives for papermaking are used. Especially, paper strengtheners, freeness improvers, retention aid, etc. are important agents for improving paper quality and enhancing productivity. Therefore, they are now more widely used and also attempts to improve these agents are being made. The background of the fact is the circumstances in which use of virgin pulp is restricted because of shortage in pulpwood supply, energy-saving is imperative, necessity of using waste paper has increased for effective use of natural resources and dirt in white water has increased by wide employment of the closed-system treatment of white water because of legal control of drainage.

As additives for papermaking, starches, polyamidepolyamine-epichlorohydrin resins, melamine-formaldehyde resins, urea-formaldehyde resins, acrylamide polymers mainly comprising acrylamide, etc. are now used in accordance with the respective purposes. Among these, acrylamide polymers are most widely used because of advantages in synthesizing, performance, easiness in handling, etc. It is considered that the hydrogen bonding ability of the carbamoyl group of acrylamides enhances the hydrogen bond between cellulose fibers and that between cellulose and polyacrylamide and thus increases the dry paper strength.

As acrylamide polymer additives for papermaking, anionic, cationic and amphoteric copolymers are known. The anionic copolymers include copolymers of an acrylamide and a vinyl monomer containing anionic groups and partial hydrolysate of acrylamide polymers, etc. The cationic copolymers include copolymers of an acrylamide and a vinyl monomer containing cationic groups, Hoffmann-reaction-modified or Mannich-reaction-modified copolymers of an acrylamide and a vinyl monomer containing anionic groups, etc. The amphoteric copolymers include copolymers of an acrylamide, a vinyl monomer containing cationic groups, and a vinyl monomer containing anionic groups; and copolymers of these monomers and a nonionic vinyl monomer copolymerizable with the former if desired (Laid-Open Patent Publication No. Sho 60-94697, Sho 62-45798, Sho 62-85100, Hei 3-227484 and Hei 6-93594, for instance), Hoffmann-reaction-modified or Mannich reaction-modified copolymers of an acrylamide and a vinyl monomer containing anionic groups, etc.

Ionic monomers are introduced into polyacrylamide in order to fix polyacrylamide onto cellulose fibers. The anionic groups introduced into acrylamide polymers fix the polyacrylamides to cellulose fibers with the aid of aluminum sulfate and the cationic groups introduced in acrylamide polymers fix the polyacrylamides to cellulose fibers by themselves.

Problems to be Solved by the Invention

The papermaking industry today involves problems such as poorer supply of materials, higher speed operation of papermaking machines, increase of dirt in white water produced in papermaking, fluctuation of pH thereof, etc.

Under the circumstances, new additives for papermaking which bring about freeness, retention and paper-strengthening effect far better than the conventional additives are being desired.

The purpose of the present invention is to provide a new papermaking additive which contains an acrylamide copolymer and brings about higher freeness, higher retention and effect for enhancing paper strength in an acidic to neutral or alkaline papermaking system and provides paper with higher strength far more excellent in comparison with conventional acrylamide copolymer additives and a process for papermaking using the same.

Disclosure of the Invention

That is, the present invention provides a papermaking additive which comprises an aqueous solution of copolymer obtained by reacting (a) an acrylamide, (b) a vinyl monomer which is copolymerizable with component (a) and has a cationic group, (c) at least one of vinyl monomers which are copolymerizable with components (a) and (b) and have 2, 3 or 4 carboxyl groups in a molecule thereof and/or a salt thereof and (d) a cross-linking compound in the presence of (f) at least one of ethylene glycol, diethylene glycol, diethanolamine and glycerin; or by reacting the above-mentioned components (a), (b), (c), (e) a nonionic vinyl monomer, which is copolymerizable with the above components (a), (b) and (c), and (d) a cross-linking compound in the presence of (f) at least one of ethylene glycol, diethylene glycol, diethanolamine and glycerin and a process for papermaking which comprises conducting papermaking in an acidic to neutral or alkaline papermaking system using a pulp slurry containing said papermaking agent.

In the present invention, the above-mentioned (a) acrylamide includes acrylamide, methacrylamide as well as N-substituted acrylamides such as N-methyl(meth) acrylamide, N-ethyl(meth)-acrylamide, N,N-dimethyl (meth)acrylamide, N-iso-propyl(meth)-acrylamide, N-t-octyl(meth)acrylamide, etc. One of them can be used alone or two or more of them can be used in combination.

The above-mentioned (b) vinyl monomer includes vinyl monomers containing tertiary, secondary or primary amino group such as dimethylaminoethyl (meth)acrylate, diethylaminoethyl (meth)acrylate, dimethylaminopropyl (meth) acrylate, diethylaminopropyl (meth)acrylate, dimethylaminopropyl(meth)acrylamide, diethylaminopropyl(meth)acrylamide, an alkyldiallylamine, a dialkylallylamine, diallylamine, allylamine etc. or their salts of inorganic or organic acid such as hydrochloric acid, sulfuric acid, formic acid, acetic acid, etc., and vinyl monomers containing a quaternary ammonium salt group, which are obtained by reacting a tertiary amino group-containing vinyl monomer and a quaternizing agent including an alkyl halide such as methyl chloride, methyl bromide, etc.; aralkyl halide such as benzyl chloride, benzyl bromide, etc.; dimethyl sulfate, diethyl sulfate, epichlorohydrin, 3-chloro-2-hydroxy -propyltrimethyl ammonium chloride, a glycidyltrialkylammonium chloride, etc. An example thereof is 2-hydroxy-N,N,N,N',N'-pentamethyl-N'-[3-{(1-oxo-2-propenyl)-amino}propyl]-1,3-propanediaminium dichloride. Further examples of the above-mentioned (6) vinyl monomer include [3-(acryloylamino)propyl]

trimethylammonium chloride, [2-(methacryloyloxy)ethyl] trimethylammonium chloride, [2-(acryloyloxy)ethyl] trimethylammonium chloride, [2-(acryloyloxy)ethyl] dimethylbenzylammonium chloride and [3-(acryloylamino) propyl]dimethylbenzylammonium chloride. One of these can be used alone or two or more can be used in combination.

Typical examples of the above-mentioned (c) vinyl monomer which is copolymerizable with components (a) and (b) and has 2, 3 or 4 carboxyl groups in one molecule are: divalent unsaturated carboxylic acid such as maleic acid, fumaric acid, itaconic acid, muconic acid, citraconic acid, etc., and their salts of an alkali metal such as sodium, potassium, etc. and ammonium salt; trivalent or tetravalent unsaturated carboxylic acids such as 3-butene-1,2,3-tricarboxylic acid, 4-pentene-1,2,4-tricarboxylic acid, aconitic acid, 4-pentene-1,2,3,4-tetracarboxylic acid, etc. and their sodium salt, potassium salt, ammonium salt, etc. One of these can be used alone or two or more can be used in combination.

Incidentally, when a monovalent unsaturated carboxylic acid such as (meth)acrylic acid, crotonic acid, etc. and an organic sulfonic acid such as vinylsulfonic acid, styrenesulfonic acid, allylsulfonic acid, 2-acrylamide-2-methylpropanesulfonic acid, etc. is used, effect of carrying out the reaction in the presence of at least one of ethylene glycol, diethylene glycol, diethanolamine, glycerin is not exhibited. However, it is of no problem to use anionic monomers other than the essential (c) component anionic monomers or salts thereof in combination with the (c) component.

As the above-mentioned (d) cross-linking compounds, di(meth)acrylates such as ethyleneglycol di(meth)acrylate, diethyleneglycol di(meth)acrylate, triethyleneglycol di(meth)acrylate, propyleneglycol di(meth)acrylate, etc.; glycerin di(meth)acrylate, trimethylolpropane-ethylene oxide adduct triacrylate; bis(meth)acrylamides such as methylene-bis-(meth)acrylamide, ethylene-bis-(meth) acrylamide, hexamethylene-bis-(meth)acrylamide, N,N'-bis-acrylamide acetic acid, N,N'-bis-acrylamide-methyl acetate, N,N-benzylidene-bis-acrylamide, etc.; divinyl esters such as divinyl adipate, divinyl sebacate, etc.; epoxyacrylates, urethane acrylates, bifunctional vinyl monomers such as allyl (meth)acrylate, diallyl phthalate, diallyl maleate, diallyl succinate, diallylacrylamide, divinylbenzene, diisopropylbenzene, N,N-diallylmethacrylamide, N-methylolacrylamide, diallyldimethylammonium chloride, diallylchlorendate, glycidyl (meth)acrylate, etc.; trifunctional vinyl monomers such as 1,3,5-triacryloylhexahydro-S-triazine, triallyl isocyanurate, N,N-diallylacrylamide, triallylamine, triallyl trimellitate, etc.; tetrafunctional vinyl monomers such as tetramethylolmethane tetraacrylate, tetraallyl pyromellitate, N,N,N',N'-tetraallyl-1,4-diamino-butane, tetraallylamine salts, tetraallyloxyethane, etc.; water soluble aziridinyl compounds such as tetramethylolmethane-tri-β-aziridinyl propionate, trimethylolpropane-tri-β-aziridinyl propionate, 4,4'-bis-(ethyleneimine-carbonyl-amino)diphenylmethane, etc.; water-soluble multifunctional epoxy compounds such as (poly)ethyleneglycoldiglycidylether, (poly) propyleneglycoldiglycidylether, (poly) glycerindiglycidylether, (poly)glycerintriglycidylether, etc. can be referred to.

Further, silicone compounds such as 3-(meth) acryloxymethyltrimethoxysilane, 3-(meth) acryloxypropyldimethoxymethylsilane, 3-(meth) acryloxypropyltrimethoxysilane, 3-(meth) acryloxypropylmethyldichlorosilane, 3-(meth) acryloxyoctadecyltriacetoxysilane, 3-(meth)acryloxy-2,5-dimethylhexyldiacetoxymethylsilane, 3-(meth) acrylamidepropyltrimethoxysilane, 2-(meth)acrylamide-ethyltrimethoxysilane, 1-(meth)acrylamide-methyltrimethoxysilane, 2-(meth)acrylamide-2-methylpropyltrimethoxysilane, 2-(meth)acrylamide-2-methylethyltrimethoxysilane, 2-(meth)acrylamide-isopropyltrimethoxysilane, 3-(meth)acrylamide-propyltriethoxysilane, N-(2-(meth)acrylamide-ethyl) aminopropyltrimethoxysilane, (3-(meth)acrylamidepropyl) oxypropyltrimethoxysilane, 3-(N-methyl(meth)acrylamide) -propyltrimethoxysilane, 3-((meth)acrylamide-methoxy)-3-hydroxypropyltrimethoxysilane, 3-((meth) acrylamidemethoxy)propyltrimethoxysilane, 3-(vinylbenzylaminopropyl)trimethoxysilane, dimethyl-3-(meth)acrylamidepropyl-3-(trimethoxysilyl) propylammonium chloride, dimethyl-2-(meth)acrylamide-2-methylpropyl-3-(tri-methoxysilyl)propylammonium chloride, 3-(meth)acrylamide-propylmethyldimethoxysilane, 3-(meth)acrylamide-propyldimethylmethoxy-silane, 3-(meth)acrylamide-propylisobutyldimethoxysilane, 2-(meth)-acrylamidepropylisobutyldimethoxy-silane, 2-(meth) acrylamide-2-methylpropylmonochlorodimethoxysilane, 2-(meth)acrylamide-2-methylpropylhydrodiene-dimethoxysilane, 3-(meth)acrylamide-propylbenzyldiethoxysilane, 3-(meth)acryl-amide-propyltriacetoxysilane, 2-(meth)acrylamide-ethyltriacetoxysilane, 4-(meth)acrylamide-butyltriacetoxysilane, 2-(meth)acrylamide-2-methylpropyltriacetoxysilane, N-(2-(meth)acrylamide-ethyl)aminopropyltriacetoxysilane, 2-(N-ethyl(meth) acrylamide)ethyltriacetoxysilane, 3-(meth)acrylamide-propyloctyldiacetoxysilane, 1-(meth)acryl-amide-methylphenyldi-acetoxysilane, 3-(meth)acrylamide-propyltripropionyloxy-silane, 3-(meth)acrylamide-propyltri (N-methyl-aminoethoxy)-silane, vinyltrichlorosilane, vinylmethyldichlorosilane, divinyldichlorosilane, vinylphenyldichlorosilane, vinyldimethylchlorosilane, vinylmethylphenylchlorosilane, vinyldiphenylchlorosilane, vinyltrimethoxysilane, vinylmethyldimethoxysilane, vinylisobutyldimethoxysilane, vinyldimethylmethoxysilane, vinyltriethoxysilane, 3-vinylbenzylamino-propyttriethoxysilane, vinylmethyldiethoxysilane, divinyldi-ethoxysilane, vinyldimethylethoxysilane, vinyldiphenylethoxy-silane, vinyltriisopropoxysilane, vinyltributoxysilane, vinyldimethylisobutoxysilane, vinyl-triphenoxysilane, vinyl-dimethyl(3-aminophenoxy)silane, vinyldimethyl(4-aminophenoxy)-silane, vinyldimethyl-(3-methyl-4-chlorophenoxy)silane, vinyldimethyl(2-methyl-4-chlorophenoxy)-silane, vinyltriacetoxysilane, vinylmethyldiacetoxysilane, vinyldimethylacetoxysilane, etc. can be referred to.

Because of the introduction of cross-linking structure by the cross-linking compound (d), the molecule expands and thus the number of contact points with fibers increases. Therefore, freeness, retention and paper-strengthening effect are enhanced.

As nonionic vinyl monomers (e) which are copolymerizable with the above-described component monomers, esters of an alcohol and (meth)acrylic acid such as methylacrylate, methylmethacrylate, ethylacrylate and ethyl methacrylate, (meth)acrylonitrile; styrene, a styrene derivative, vinyl acetate, vinyl propionate, methyl-vinylether, etc. can be referred to, for example.

In the present invention, the amount of each of the employed components (a)–(f) should be determined by fully considering performance of the resulting additive for papermaking. The preferred ranges thereof are as follows.

The amount of component (a) is usually 98–60 mol %, preferably 96–70 mol %, and more preferably 95–80 mol % of the total molar amount of components (a), (b) and (c) or components (a), (b), (c) and (e). Likewise, the amount of component (b) to be used is usually 1–20 mol %, preferably 2–15 mol %, and more preferably 3–10 mol % thereof; the amount of component (c) to be used is usually 0.5–20 mol %, preferably 1–15 mol %, and more preferably 1.5–10 mol % thereof. The amount of component (d) to be used is usually 0.005–5 mol %, preferably 0.0075–2.5 mol %, more preferably 0.01–1.5 mol %. The amount of component (e) to be used is usually 0.1–20 mol %, preferably 0.2–10 mol % and more preferably 0.5–7.5 mol % of the total amount of components (a), (b), (c) and (e).

It is desirable to carry out the copolymerization in the presence of (f) at least one of ethylene glycol, diethylene glycol, diethanolamine and glycerin in an amount of 0.1–5 mol % of the total molar amount of the components (a), (b) and (c) or the components (a), (b), (c) and (e).

Preferably, component (f) is used in an amount of 0.2–3 mol % and more preferably in an amount of 0.3–2 mol %.

when the amounts of components (b) and (c) to be used are less than the above range, the freeness, retention and paper-strengthening effect of the resulting additive are not improved. And if they are in excess of the above-described range, freeness, retention and paper strength are reduced and yet the preparation cost increases.

When the amount of component (d) is less than 0.005 mol %, freeness, retention and improvement of paper strength are not remarkable, and when it is in excess of 5 mol %, resulting copolymer is so viscous or water-insoluble that the handling of the polymer is difficult.

If the amount of component (f) is less than 0.1 mol %, often effects of improving freeness, retention and paper strengthening are poor. If it is in excess of 5 mol %, freeness, retention and paper strength are improved only to some level or not improved.

Preparation of acrylamide copolymers used for this invention can be carried out by any known conventional process. For instance, it is carried out as follows. Components (a), (b), (c), (d), (e) if used, and (f) are placed together with water in any reaction vessel in amounts that the monomer concentration be 2–40 wt %, preferably 5–30 wt % and a radical polymerization initiator is added. If required, a known chain transfer agent such as alkylmercaptans, thioglycollic acids or esters thereof, isopropyl alcohol, allyl alcohol, etc. can be suitably added. The reaction mixture is heated under stirring. Thus the desired acrylamide copolymers can be obtained. Needless to say, each component of (a), (b), (c), (d), (e) if used, and (f) can be added suitably by continuous dropping or any procedure in accordance with the characteristics of each component.

As radical polymerization initiators, persulfate such as sodium persulfate, potassium persulfate, ammonium persulfate, etc.; peroxides such as hydrogen peroxide, benzoyl peroxide, tert-butylperoxide, etc.; bromate salts such as sodium bromate, potassium bromate, etc.; perborate salts such as sodium perborate, potassium perborate, ammonium perborate, etc.; percarbonates such as sodium percarbonate, potassium percarbonate, ammonium percarbonate, etc.; and perphosphates such as sodium perphosphate, potassium perphosphate, ammonium perphosphate, etc. can be referred to.

Although these initiators can be used alone, they can be used as a redox polymerization initiator in combination with a reducing agent. Examples of the reducing agents are sulfite salts, hydrogen sulfite salts; organic amines such as N,N,N',N'-tetramethylethylenediamine, etc.; azo compounds such as 2,2'-azo-bis-2-amidinopropane hydrochloride, etc.; reducing sugars such as aldose, etc.

Also, azo compounds such as azo-bis-isobutyronitrile, 2,2'-azo-bis-2-amidinopropane hydrochloride, 2,2'-azo-bis-2,4-dimethylvaleronitrile, 4,4'-azo-bis-4-cyano-valeic acid and the salts thereof can be used. One of them can be used alone or two or more can be used in combination.

It is desirable that the viscosity of the resulting acrylamide copolymer is not higher than 15000 cps at 25° C. when measured with a Brookfield rotation viscosimeter.

The process for papermaking in accordance with the present invention comprises adding the papermaking additive in accordance with the invention in the wet end part of the papermaking line in the process for manufacturing paper or paperboard. Specifically, the papermaking additive of the present invention can be added to the aqueous pulp slurry in an amount of 0.01–8 wt % as solids of the weight of solids of the aqueous pulp slurry on the dry basis. Usually 0.05–2 wt % of the additive is used. Aluminum sulfate can be used or is not used in accordance with the species of paper. The pH can be suitably adjusted by adding an alkaline or acidic substance.

When the present invention is applied to a papermaking system containing calcium carbonate as a filler, generally calcium carbonate is used in an amount of 2–30 % on the basis of dry weight of pulp and the papermaking is conducted at a pH of 7–9. The above-described papermaking additive is added in an amount of 0.01–8 %, usually 0.05–2 % in the same manner as described above. Aluminum sulfate can also be added in a papermaking system in which calcium carbonate is used.

The present invention can be applied not only to the manufacturing of quality paper and quality paperboard in an acidic papermaking system in which a large amount of aluminum sulfate is added, but also to a papermaking system in which a large amount of calcium carbonate is contained, such as manufacturing of base paper for gypsum board, base paper for coated paper, medium quality paper, liner and corrugating medium in general from waste paper; to a papermaking system, in which aluminum sulfate cannot be used, or use of aluminum sulfate is restricted to a small amount, such as manufacturing of neutral pure-white bowl paper, neutral liner, antic-rust liner, anti-rust interleaving paper, etc.; or to a papermaking system in which use of a retention aid is restricted, such as manufacturing of craft paper.

The invention gives paper of excellent quality also in a papermaking system in which calcium carbonate is used as a filler, such as manufacturing of neutral printing and writing paper, neutral base paper for coated paper, neutral PPC paper, neutral heat-sensitive base paper, neutral pressure-sensitive base paper, neutral paper for ink-jet printing and information paper.

When various kinds of paper and paperboard are manufactured in an acidic to neutral and alkaline pH range, any of bleached or unbleached chemical pulp such as craft pulp, sulfite pulp, etc.; bleached or unbleached high yield pulp such as ground pulp, mechanical pulp, thermomechanical pulp, etc.; waste paper pulp such as waste newsprint paper pulp, waste magazine pulp, waste corrugated board, deinked waste paper pulp, etc. can be used as pulp stock. Also a mixture of above-described pulp material and fibers of asbestos, polyamide, polyester, polyolefin, etc. can be used.

Fillers, dyes, rosin sizing agents for acidic papermaking, sizing agent for weakly acidic, neutral or alkaline papermaking system such as alkylketene dimer, alkenyl succinic acid anhydride, special modified rosin sizing agent as well as any other papermaking additive such as dry strength agent, wet strength agent, retention aid, freeness improver, defoamer, etc. can be used as required depending upon the characteristics desired in the resulting paper. As fillers, clay, talc, titanium oxide, wet ground calcium carbonate, precipitated calcium carbonate, etc. are usable, and they can be used alone or as a combination of two or more.

By using the additive for papermaking of the present invention, excellent freeness and high retention are achieved in the papermaking process and paper having excellent strength is obtained.

SPECIFIC DESCRIPTION OF THE INVENTION

Now the invention is described by way of working and comparative examples. Needless to say, the invention is not limited to these working examples. The percentage used in the examples are on the basis of weight.

EXAMPLE 1

In a four-necked flask equipped with a stirrer, a thermometer, a reflux cooler and a nitrogen inlet tube, 198.37 g of a 50% aqueous solution of acrylamide (93.0 mol %), 11.79 g (5.0 mol %) of dimethylaminoethyl methacrylate, 3.90 g (2.0 mol %) of itaconic acid, 5.78 g of a 1% aqueous solution of methylene-bis-acrylamide (0.025 mol %), 0.093 g (0.1 mol %) of ethyleneglycol, 31.55 g of isopropyl alcohol, 469.85 g of water and 17.25 g of a 20% aqueous solution of sulfuric acid were placed. The pH of the reaction mixture was 3.0. The reaction mixture was heated to 60° C. as nitrogen was introduced. Then 4.56 g of a 5% aqueous solution of ammonium persulfate was added to the reaction mixture, which was further heated to 80° C. while nitrogen being introduced to allow reaction for 2 hours at this temperature. Thus an aqueous solution of a copolymer was obtained. The solid content thereof was 20.3%, the viscosity was 6170 cps (when measured by a Brookfield rotation viscosimeter at 25° C.) and the pH was 3.7. This copolymer solution was designated Additive A. The properties of the obtained copolymer solution are shown in Table 1.

EXAMPLES 2–8 AND COMPARATIVE EXAMPLES 1–11

The procedures of Example 1 were repeated with respect to the varied species and amounts of components (a)–(f) as indicated in Table 1. The species and amounts of the polymerization initiator and the chain transfer agent were suitably varied.

Properties of the copolymer solutions obtained in Examples 2–8 and Comparative Examples 1–11 are shown in Table 1 and Table 2. Comparative Example 1 corresponds to Examples 1–4 in which component (f) was not used. Comparative Example 2 corresponds to Example 5 in which component (f) was not used. Comparative Example 3 corresponds to Example 6 in which component (f) was not used. Comparative Example 4 was a case in which acrylic acid was used instead of component (c) and component (f) was not used. Comparative Example 5 is a case in which acrylic acid was used instead of component (c) and component (f) was used. Comparative Example 6 is a case in which 2-acrylamide-2-methylpropanesulfonic acid was used instead of component (c) and component (f) was not used. Comparative Example 7 is a case in which 2-acrylamide-2-methylpropane-sulfonic acid was used instead of component (c) and component (f) was used. Comparative Example 8 is a case in which polyethyleneglycol was used instead of component (f). Comparative Example 9 is a case in which component (d) was not used. Comparative Examples 10 and 11 respectively correspond to Examples 7 and 8 in which component (f) was not used.

The abbreviations used in Tables 1 and 2 mean:

AAm: acrylamide
MAAm: methacrylamide
DMAAm: N,N-dimethylacrylamide
DM: dimethylaminoethyl methacrylate
DPA: dimethylaminopropylacrylamide
DMBz: methacryloyloxyethyldimethylbenzylammonium chloride
BQA: 2-hydroxy-N,N,N,N',N'-pentamethyl-N'-[3-{(1-oxo-2-propenyl)amino}-propyl]-1,3-propanediaminium dichloride
DAA: diallylamine
IA: itaconic acid
AAc: acrylic acid
MA: maleic acid
BTCA: 3-butene-1,2,3-tricarboxylic acid
FA: fumaric acid
MBAAm: methylene-bis-acrylamide
TMAIC: trimethallyl isocyanurate
TAF: 1,3,5-triacryloylhexahydro-s-triazine
AN: acrylonitrile
ST: styrene
EG: ethyleneglycol
PEG400: polyethyleneglycol having average MW of 400
DEG: diethyleneglycol
Gly: glycerin
DEA: diethanolamine
AMPS: 2-acrylamide-2-methylpropanesulfonic acid

TABLE 1

| | | COMPOSITION (MOL %) | | | | | | | PROPERTIES | | |
|---|---|---|---|---|---|---|---|---|---|---|---|
| | | | | | ANIONIC MONOMER OTHER THAN (C) | | | | | | |
| WORKING EXAMPLE | | COMPONENT (a) | COMPONENT (b) | COMPONENT (c) | | COMPONENT (d) | COM-PONENT (e) | COM-PONENT (f) | TOTAL SOLIDS (%) | VISC'Y (cps) | pH |
| 1 | A | AAm 93 | DM 5 | IA 2 | | MBAAm 0.025 | | EG 0.1 | 20.3 | 6170 | 3.7 |
| 2 | B | AAm 93 | DM 5 | IA 2 | | MBAAm 0.025 | | EG 0.4 | 20.2 | 6160 | 3.6 |
| 3 | C | AAm 93 | DM 5 | IA 2 | | MBAAm 0.025 | | EG 1.2 | 20.6 | 6570 | 3.8 |
| 4 | D | AAm 93 | DM 5 | IA 2 | | MBAAm 0.025 | | EG 5.0 | 20.6 | 6410 | 3.8 |
| 5 | E | AAm 85.7 | DM 2.5 | BTCA 1.3 | | TAF 0.02 | ST 3 | Gly 1.2 | 20.2 | 7250 | 3.8 |

TABLE 1-continued

| WORKING EXAMPLE | | COMPOSITION (MOL %) COMPONENT (a) | COMPONENT (b) | COMPONENT (c) | ANIONIC MONOMER OTHER THAN (C) | COMPONENT (d) | COM-PONENT (e) | COM-PONENT (f) | PROPERTIES TOTAL SOLIDS (%) | VISC'Y (cps) | pH |
|---|---|---|---|---|---|---|---|---|---|---|---|
| | | MAAm 5.0 | DMBz 2.5 | | | | | | | | |
| 6 | F | AAm 90.0 | DM 2.5 | FA 1 | | MBAAm 0.025 | | DEA 1.2 | 20.5 | 7060 | 3.6 |
| | | DMAAM 4.25 | BQA 1.25 | IA 1 | | | | | | | |
| 7 | G | AAm 90 | DPA 5 | MA 1 | AAc 2 | TMAIC 0.02 | AN 2 | DEG 1.2 | 20.6 | 7100 | 3.6 |
| 8 | H | AAm 93 | DAA 5 | IA 2 | | TMAIC 0.02 | | EG 1.2 | 20.5 | 7160 | 4.0 |

TABLE 2

| COM-PARA-TIVE EXAM-PLE | | COMPOSITION (MOL %) COMPONENT (a) | COM-PONENT (b) | COMPONENT (c) | ANIONIC MONOMER OTHER THAN (C) | COMPONENT (d) | COM-PONENT (e) | COM-PONENT (f) | OTHERS | PROPERTIES SOLIDS (%) | VISC'Y (CPS) | PH |
|---|---|---|---|---|---|---|---|---|---|---|---|---|
| 1 | I | AAm 93 | DM 5 | IA 2 | | MBAAm 0.025 | | | | 20.3 | 6950 | 3.5 |
| 2 | J | AAm 85.7 | DM 2.5 | BTCA 1.3 | | TAF 0.02 | ST 3 | | | 20.6 | 6780 | 3.7 |
| | | MAAm 5.0 | DMBz 2.5 | | | | | | | | | |
| 3 | K | AAm 90.0 | DM 2.5 | FA 2 | | MBAAm 0.025 | | | | 20.2 | 7420 | 3.7 |
| | | DMAAM 4.25 | BQA 1.25 | | | | | | | | | |
| 4 | L | AAm 91 | DM 5 | | AAc 4 | MBAAm 0.025 | | | | 20.5 | 7080 | 3.4 |
| 5 | M | AAm 91 | DM 5 | | AAc 4 | MBAAm 0.025 | | EG 1.2 | | 20.5 | 7210 | 3.0 |
| 6 | N | AAm 91 | DM 5 | | AMPS 4 | MBAAm 0.025 | | | | 20.4 | 7330 | 3.1 |
| 7 | O | AAm 91 | DM 5 | | AMPS 4 | MBAAm 0.025 | | EG 1.2 | | 20.6 | 7180 | 3.2 |
| 8 | P | AAm 90 | DM 5 | | AAc 4 | MBAAm 0.025 | | | PEG400 2 | 20.2 | 7510 | 4.1 |
| 9 | Q | AAm 93 | DM 5 | IA 2 | | | | EG 1.2 | | 20.1 | 7250 | 4.0 |
| 10 | R | AAm 90 | DPA 5 | MA 1 | AAc 2 | TMAIC 0.02 | AN 2 | | | 20.5 | 7090 | 3.6 |
| 11 | S | AAm 93 | DAA 5 | IA 2 | | TMAIC 0.02 | | | | 20.3 | 7400 | 4.0 |

THE AMOUNT OF PEG 400 IN COMPARATIVE EXAMPLE 8 IS PERCENTAGE SUPPORSING THAT THE TOTAL AMOUNT OF (a), (b), (c) and (e) IS 100 WT %.

USE EXAMPLES 1–6 AND COMPARATIVE USE EXAMPLES 1–9

To a 2.4% pulp slurry made from waste corrugated board, whose degree of beating (Canadian Standard Freeness (C.S.F)) was adjusted to 305 ml, 1.5% (on the basis of absolute dry pulp weight) of aluminum sulfate was added. The pH of the slurry was 6.4. To portions of the slurry, respectively, aqueous acrylamide copolymer solutions, i.e., papermaking additives, obtained in Examples 1–6 and Comparative Examples 1–9 were added in an amount of 0.8% on the basis of the absolute dry pulp weight. The portions of the slurry were diluted to 0.25% pulp concentration and were made into paper using a sheet paper machine manufactured by Noble & Wood. The prepared paper samples were dried at 110° C. for 90 seconds and two groups of hand-made paper samples having basic weight of 80 g/m$^2$ (for the test of burst strength) and 170 g/m$^2$ (for the test of compressive strength) were obtained. The paper samples were kept in a thermohygrostat chamber of 20° C. and 65% RH to adjust moisture content of the samples. Thereafter, the samples were subjected to the evaluation tests. Samples made without using the papermaking additives were also tested in the same manner.

The results of the evaluation tests are shown in Table 3. Compressive strength factor (ring-crush factor): JIS P 8126 Burst strength factor: JIS P 8112 DDT: An apparatus similar to the "Dynamic Drainage Jar" described in Tappi Journal, Vol. 56, No. 10 (1973), page 46 was prepared. Each 500 ml of the pulp slurry (conc. 0.25%) portions, to which papermaking additive was added, was poured into the jar having a diameter of 7.5 cm. The jar was rotated at 800 rpm for stirring and the cock at the bottom was opened so that the slurry was filtered through a screen of 100 mesh, and the time until the amount of the filtrate reached a predetermined volume was measured. In this case, the time until the volume of the filtrate reached 250 ml was measured. The smaller the DDT value, the better the freeness. RDDT:Into an apparatus similar to "modified Hercules Dynamic Drainage tester" (with a jar having a diameter of 7.5 cm) described in the proceedings of Tappi Papermakers Conference (1985), p.171, pulp slurry was poured and the jar was rotated at 800 rpm for agitation. Air was blown in from the bottom lest mat was formed. The apparatus had a structure which allows filtration simultaneously with the cease of agitation and aeration. 500 ml of the slurry (conc. 0.25%) containing the papermaking additive was poured into the jar and 50 ml of the filtrate was collected and transmission (T.M. %) at 620 nm wave length was measured. This T. M. (%) value was used as a parameter of the first pass retention. The higher the T.M.(%), the more transparent the filtrate and the higher are the retention of the filler and fine fibers.

TABLE 3

| | | ADDITIVE | DDT (sec) | RDDT (TM %) | COMPRESSIVE STRENGTH FACTOR (RING-CRUSH FACTOR) | BURST STRENGTH FACTOR |
|---|---|---|---|---|---|---|
| | | NONE | 60.3 | 36.5 | 18.9 | 2.53 |
| INVENTION EXAMPLE | 1 | A | 19.3 | 52.8 | 21.8 | 3.24 |
| | 2 | B | 18.0 | 54.0 | 22.2 | 3.25 |
| | 3 | C | 16.2 | 55.3 | 22.4 | 3.38 |
| | 4 | D | 20.5 | 52.7 | 22.0 | 3.20 |
| | 5 | E | 17.9 | 53.8 | 22.6 | 3.31 |
| | 6 | F | 20.7 | 51.2 | 22.3 | 3.35 |
| COMPARATIVE EXAMPLE | 1 | I | 23.9 | 50.5 | 21.0 | 3.07 |
| | 2 | J | 22.4 | 50.3 | 21.5 | 3.17 |
| | 3 | K | 23.9 | 48.0 | 20.8 | 3.13 |
| | 4 | L | 24.4 | 42.5 | 21.8 | 3.08 |
| | 5 | M | 23.8 | 43.0 | 21.6 | 3.11 |
| | 6 | N | 32.5 | 41.0 | 19.8 | 2.84 |
| | 7 | O | 33.2 | 41.3 | 20.5 | 2.80 |
| | 8 | P | 24.7 | 42.1 | 21.2 | 3.02 |
| | 9 | Q | 41.6 | 38.8 | 20.1 | 2.93 |

USE EXAMPLE 7 AND 8 AND COMPARATIVE EXAMPLE 10 AND 11

To a 2.4% pulp slurry, whose freeness was adjusted to C. S. F. 390 ml (BKP L/N=8/2), 10% of calcium carbonate (Tamapearl 121S supplied by Okutama Kogyo Kabushiki Kaisha, 0.25% of papermaking additives obtained in the above Examples 7 and 8 and Comparative Examples 10 and 11, 0.3% of amphoteric tapioca starch CATO 3210 supplied by National Starch and Chemicals, Inc., 0.5% of aluminum sulfate 0.08% of sizing agent AS-263 (Alkylketene dimer emulsion sizing agent supplied by Japan PMC Corporation were added successively in this order and the slurry was stirred.

The pulp slurry was diluted with water having a pH of 8 so that the concentration thereof was 0.25%. To this slurry, 0.01% of a retention aid Hymorock NR-12MLS supplied by Hymo, Inc. was added and the slurry was made into paper using sheet paper machine manufactured by Noble & Wood and thus hand-made paper having a basic weight of 80 g/m$^2$ was obtained. The paper was kept in a thermohygrostat chamber of 20° C. and 65% RH for 24 hours so as to adjust the moisture content and subjected to the evaluation tests. With respect to the paper samples, which were made without using the papermaking additives were also subjected to the evaluation tests in the same manner. The above-mentioned amount of additives was solid content ratio on the basis of absolute dry pulp weight.

The test results are shown in Table 4. Methods of measurements were as follows:

Burst strength factor, DDT and RDDT were measured by the same methods as described above.

Internal bond strength (Scott Bond): was measured using a bond tester (manufactured by Kumagaya Rikikogyo Co., Ltd.) with an adhesion strength of 100 kg/cm$^2$ for 30 sec.

Breaking length: JIS P 8113

Ash content: JIS P 8128

TABLE 4

| | | ADDITIVE | DDT (sec) | RDDT (TM %) | ASH (%) | BURST STRENGTH | BREAKING LENGTH (km) | INTERNAL BOND STRENGTH (kgf · cm) |
|---|---|---|---|---|---|---|---|---|
| | | NONE | 47.2 | 32.8 | 5.2 | 1.82 | 2.95 | 1.72 |
| INVENTION | 7 | G | 31.2 | 51.1 | 7.6 | 2.67 | 4.19 | 2.78 |
| EXAMPLE | 8 | H | 34.6 | 45.5 | 6.9 | 2.40 | 4.03 | 2.41 |
| COMPARATIVE | 10 | R | 38.1 | 40.6 | 6.3 | 2.22 | 3.83 | 2.15 |
| EXAMPLE | 11 | S | 40.2 | 38.4 | 6.0 | 2.01 | 3.69 | 2.02 |

Effect of the Invention

As apparent from Tables 3 and 4, use of the papermaking additives of the present invention brings about excellent freeness and retention in the papermaking step and gives paper provided with excellent strength in comparison with the conventional additives.

What we claim is:

1. An additive for papermaking comprising an aqueous solution of a copolymer obtained by reacting 98–60 mol % of (a) an acrylamide, 1–20 mol % of (b) a vinyl monomer which is copolymerizable with component (a) and has a cationic group, 0.5–20 mol % of (c) at least one of vinyl monomers which are copolymerizable with components (a) and (b) and have 2, 3 or 4 carboxyl groups in a molecule thereof and/or a salt thereof, with the total molar percent of components (a), (b) and (c) being 100 mol %, and 0.005–5 mol % of (d) a .cross-linking compound, with the mol % of (d) being relative to the total molar percent of components (a), (b) and (c) being 100 mol %, wherein components (a), (b), (c) and (d) are reacted in the presence of 0.1–5 mol % of (f) at least one of ethylene glycol, diethylene glycol, diethanolamine and glycerin with the mol % of (f) being relative to the total molar percent of components (a), (b) and (c) being 100 mol %.

2. The additive for papermaking as described in claim 1, which comprises an aqueous solution of a copolymer obtained by reacting 96–70 mol % of (a) an acrylamide, 2–15 mol % of (b) a vinyl monomer which is copolymerizable with component (a) and has a cationic group, 1–15 mol % of (c) at least one of vinyl monomers which are copolymerizable with components (a) and (b) and have 2, 3 or 4 carboxyl groups in a molecule thereof and/or a salt thereof, with the total molar percent of components (a), (b) and (c) being 100 mol %, and 0.0075–2.5 mol % of (d) a cross-linking compound, with the mol % of (d) being relative to the total molar amount of components (a), (b) and (c) being 100 mol %, wherein components (a), (b), (c) and (d) are reacted in the presence of 0.2–3 mol % of (f) at least one of ethylene glycol, diethylene glycol, diethanolamine and glycerin with the mol % of (f) being relative to the total molar amount of components (a), (b) and (c) being 100 mol %.

3. The additive for papermaking as described in claim 2, which comprises an aqueous solution of a copolymer obtained by reacting 95–80 mol % of (a) an acrylamide, 3–10 mol % of (b) a vinyl monomer which is copolymerizable with component (a) and has a cationic group, 1.5–10 mol % of (c) at least one of vinyl monomers which are copolymerizable with components (a) and (b) and have 2, 3 or 4 carboxyl groups in a molecule thereof and/or a salt thereof, with the total molar percent of components (a) , (b) and (c) being 100 mol %, and 0.01–1.5 mol % of (d) a cross-linking compound, with the mol % of (d) being relative to the total molar amount of components (a), (b) and (c) being 100 mol %, wherein components (a), (b), (c) and (d) are reacted in the presence of 0.3–2 mol % of (f) at least one of ethylene glycol, diethylene glycol, diethanolamine and glycerin with the mol % of (d) being relative to the total molar amount of components (a), (b) and (c) being 100 mol %.

4. An additive for papermaking comprising an aqueous solution of a copolymer obtained by reacting 98–60 mol % of (a) an acrylamide, 1–20 mol % of (b) a vinyl monomer which is copolymerizable with component (a) and has a cationic group, 0.5–20 mol % of (c) at least one of vinyl monomers which are copolymerizable with components (a) and (b) and have 2, 3 or 4 carboxyl groups in a molecule thereof and/or a salt thereof, 0.1–20 mol % of (e) a nonionic vinyl monomer which is copolymerizable with the above components (a), (b) and (c), with the total molar percent of components (a), (b), (c) and (e) being 100 mol % and 0.005–5 mol % of (d) a cross-linking compound with the mol % of (d) being relative to the total molar percent of components (a), (b), (c) and (e) being 100 mol %, wherein components (a), (b), (c), (d) and (e) are reacted in the presence of 0.1–5 mol % of (f) at least one of ethylene glycol, diethylene glycol, diethanolamine and glycerin, with the mol % of (f) being relative to the total molar percent of components (a), (b), (c) and (e) being 100 mol %.

5. The additive for papermaking as claimed in claim 4, which comprises an aqueous solution of a copolymer obtained by reacting 96–70 mol % of (a) an acrylamide, 2–15 mol % of (b) a vinyl monomer which is copolymerizable with component (a) and has a cationic group, 1–15 mol % of (c) at least one of vinyl monomers which are copolymerizable with components (a) and (b) and have 2, 3 or 4 carboxyl groups in a molecule thereof and/or a salt thereof, 0.2–10 mol % of (e) a nonionic vinyl monomer which is copolymerizable with the above components (a), (b) and (c), with the total molar percent of components (a), (b), (c) and (e) being 100 mol % and 0.0075–2.5 mol % of (d) a cross-linking compound with the mol % of (d) being relative to the total molar percent of components (a), (b), (c) and (e) being 100 mol %, wherein components (a), (b), (c), (d) and (e) are reacted in the presence of 0.2–3 mol % of (f) at least one of ethylene glycol, diethylene glycol, diethanolamine and glycerin, with the mol % of (f) being relative to the total molar percent of components (a), (b), (c) and (e) being 100 mol %.

6. The additive for papermaking as claimed in claim 5, which comprises an aqueous solution of a copolymer obtained by reacting 95–80 mol % of (a) an acrylamide, 3–10 mol % of (b) a vinyl monomer which is copolymerizable with component (a) and has a cationic group, 1.5–10 mol % of (c) at least one of vinyl monomers which are copolymerizable with components (a) and (b) and have 2, 3 or 4 carboxyl groups in a molecule thereof and/or a salt thereof, 0.5–7.5 mol % of (e) a nonionic vinyl monomer which is copolymerizable with the above components (a), (b) and (c), with the total molar percent of components (a), (b), (c) and (e) being 100 mol %, and 0.01–1.5 mol % of (d) a cross-linking compound, with the mol % of (d) being relative to the total molar percent of components (a), (b), (c) and (e) being 100 mol % wherein components (a), (b), (c), (d) and (e) are reacted in the presence of 0.3–2 mol % of (f) at least one of ethylene glycol, diethylene glycol, diethanolamine and glycerin, with the mol % of (f) being relative to the total molar percent of components (a), (b), (c) and (e) being 100 mol %.

7. The additive for papermaking as described in claim 1, wherein component (a) is selected from the group consisting of acrylamide, methacrylamide, N-methylacrylamide, N-methylmethacrylamide, N-ethylacrylamide, N-ethylmethacrylamide, N-isopropylacrylamide, N-isopropylmethacrylamide, N,N-dimethylacrylamide, N,N-dimethylmethacrylamide and N-t-octylmethacrylamide.

8. The additive for papermaking as described in claim 7, wherein component (a) is selected from the group consisting of acrylamide, methacrylamide and N,N-dimethylacrylamide.

9. The additive for papermaking as described in claim 1, wherein component (b) is selected from the group consisting of dimethylaminoethyl methacrylate,
dimethylaminoethyl acrylate,
dimethylaminopropylacrylamide,
[3-(acryloylamino)propyl]trimethylammonium chloride,
[2-(methacryloyloxy)ethyl]trimethylammonium chloride,
[2-(acryloyloxy)ethyl]trimethylammonium chloride,
[2-(methacryloyloxy)ethyl]dimethylbenzylammonium chloride,
[2-(acryloyloxy)ethyl]dimethylbenzylammonium chloride,
[3-(acryloylamino)propyl]dimethylbenzylammonium chloride,
2-hydroxy-N,N,N,N',N'-pentamethyl-N'-[3-{1-oxo-2-propenyl)amino}propyl]-1,3-propanediaminium dichloride and diallylamine.

10. The additive for papermaking as described in claim 9, wherein component (b) is selected from the group consisting of dimethylaminoethyl methacrylate,
dimethylaminoethyl acrylate,
dimethylaminopropylacrylamide,
[2-(acryloyloxy)ethyl]dimethylbenzylammonium chloride,
[2-(methacryloyloxy)ethyl]dimethylbenzylammonium chloride,
3-(acryloylamino)propyl]dimethylbenzylammonium chloride and
2-hydroxy-N,N,N,N',N'-pentamethyl-N'-[3-{(1-oxo-2-propenyl)amino}propyl]-1,3-propanediaminium dichloride.

11. The additive for papermaking as described in claim 1, wherein component (c) is selected from the group consisting of maleic acid, fumaric acid, itaconic acid, muconic acid, citraconic acid, aconic acid, 4-pentene-1,2,3,4-tetracarboxylic acid, 3-butene-1,2,3-tricarboxylic acid and 4-pentene-1,2,4-tricarboxylic acid.

12. The additive for papermaking as described in claim 11, wherein component (c) is selected from the group consisting of maleic acid, fumaric acid, itaconic acid, 3-butene-1,2,3-tricarboxylic acid and 4-pentene-1,2,4-tricarboxylic acid.

13. The additive for papermaking as described in claim 1, wherein component (d) is selected from the group consisting of ethyleneglycol diacrylate, ethyleneglycol dimethacrylate, methylene-bis-acrylamide, hexamethylene-bis-acrylamide, divinyl adipate, allyl acrylate, diallylacrylamide, divinylbenzene, 1,3,5-triacryloylhexahydro-S-triazine, triallyl isocyanurate, tetramethylolmethane tetraacrylate, tetramethylolmethane-tri-β-aziridinyl propionate, 3-methacryloxymethyltrimethoxysilane and 2-acrylamide-2-methylpropyltrimethoxysilane.

14. The additive for papermaking as described in claim 13, wherein component (d) is selected from the group consisting of methylene-bis-acrylamide, 1,3,5-triacryloylhexahydro-S-triazine, triallyl isocyanurate, tetramethylolmethane tetraacrylate, tetramethylolmethane-tri-β-aziridinyl propionate and 3-methacryloxymethyltrimethoxysilane.

15. The additive for papermaking as described in claim 4, wherein component (e) is selected from the group consisting of acrylonitrile, styrene, vinyl acetate, vinyl propionate, methylvinylether, methyl acrylate, methyl methacrylate, ethyl acrylate, ethyl methacrylate and methacrylonitrile.

16. The additive for papermaking as described in claim 15, herein component (e) is selected from the group consisting of acrylonitrile, styrene, vinyl acetate, methyl methacrylate and ethyl methacrylate.

* * * * *

UNITED STATES PATENT AND TRADEMARK OFFICE

CERTIFICATE OF CORRECTION

PATENT NO. : 5,698,627

DATED : December 16, 1997

INVENTOR(S) : Tadayoshi Oguni; Satoshi Takizawa; and Kiyoshi Iwai

It is certified that error appears in the above-identified patent and that said Letters Patent is hereby corrected as shown below:

On Title Page, [57] ABSTRACT, Line 6, "component (a) and (b)" should read --components (a) and (b)--.

Column 4 Line 44 "propyttriethoxysilane" should read --propyltriethoxysilane--.

Column 5 Line 24 "when" should read --When--.

Column 6 Line 47 "antic-rust" should read --anti-rust--.

Column 7 Line 20 "The percentage" should read --The percentages--.

Columns 9-10, Table 2, refer to note under Table, "supporsing" should be --supposing--.

Column 11 Line 22, in heading, "EXAMPLE 7 and 8" should read --EXAMPLES 7 and 8--.

Column 11 Line 23, in heading, "EXAMPLE 10 and 11" should read --EXAMPLES 10 and 11--.

Column 11 Line 44 between "sulfate" and "0.8" insert --and--.

Column 11 Line 45 after "PMC Corporation" insert right parenthesis --)--.

Claim 1 Column 12 Line 58 between "a" and "cross-linking" delete period --.--.

Claim 10 Column 14 Line 63 before "3-" insert left bracket --[--.

UNITED STATES PATENT AND TRADEMARK OFFICE

CERTIFICATE OF CORRECTION

PATENT NO. : 5,698,627

DATED : December 16, 1997

INVENTOR(S) : Tadayoshi Oguni; Satoshi Takizawa; and Kiyoshi Iwai

It is certified that error appears in the above-identified patent and that said Letters Patent is hereby corrected as shown below:

Claim 16 Column 16 Line 15 "herein" should read --wherein--.

Signed and Sealed this

Seventh Day of April, 1998

Bruce Lehman

*Attest:*

BRUCE LEHMAN

*Attesting Officer*

*Commissioner of Patents and Trademarks*